US007634877B2

(12) United States Patent
Wiercinski

(10) Patent No.: US 7,634,877 B2
(45) Date of Patent: Dec. 22, 2009

(54) SKID RESISTANT SURFACES

(75) Inventor: Robert A. Wiercinski, Lincoln, MA (US)

(73) Assignee: W. R. Grace & Co.—Conn., Columbia, MD (US)

( * ) Notice: Subject to any disclaimer, the term of this patent is extended or adjusted under 35 U.S.C. 154(b) by 0 days.

(21) Appl. No.: 12/026,743

(22) Filed: Feb. 6, 2008

(65) Prior Publication Data

US 2009/0193743 A1 Aug. 6, 2009

(51) Int. Cl.
*E04D 5/10* (2006.01)

(52) U.S. Cl. ..... 52/177; 52/309.1; 52/796.1; 52/DIG. 16; 52/411

(58) Field of Classification Search ..... 52/177, 52/411, 309.1, DIG. 16; 428/144, 150, 220, 428/40.1
See application file for complete search history.

(56) References Cited

U.S. PATENT DOCUMENTS

| | | | | |
|---|---|---|---|---|
| 3,196,763 | A * | 7/1965 | Rushton | 404/21 |
| 3,909,996 | A * | 10/1975 | Ettlinger et al. | 52/177 |
| 4,715,743 | A * | 12/1987 | Schmanski | 404/9 |
| 4,994,328 | A | 2/1991 | Cogliano | |
| 5,496,615 | A | 3/1996 | Bartlett et al. | |
| 5,687,517 | A | 11/1997 | Wiercinski et al. | |
| 6,199,335 | B1 * | 3/2001 | Brenot et al. | 52/480 |
| 6,308,482 | B1 | 10/2001 | Strait | |
| 6,372,323 | B1 * | 4/2002 | Kobe et al. | 428/119 |
| 6,500,520 | B1 | 12/2002 | Wiercinski et al. | |
| 6,718,714 | B1 * | 4/2004 | Montgomery, Sr. | 52/392 |
| 6,921,566 | B2 * | 7/2005 | Lipstein | 428/40.1 |
| 7,029,744 | B2 | 4/2006 | Horstman et al. | |
| 7,401,441 | B2 * | 7/2008 | Zimmerle et al. | 52/177 |
| 2003/0066253 | A1 * | 4/2003 | Lin | 52/177 |
| 2003/0215594 | A1 | 11/2003 | Hamdar et al. | |
| 2004/0093811 | A1 * | 5/2004 | Oakey et al. | 52/177 |
| 2004/0118059 | A1 * | 6/2004 | Ohno et al. | 52/177 |
| 2004/0127120 | A1 | 7/2004 | Zanchetta et al. | |
| 2007/0044397 | A1 | 3/2007 | Wiercinski et al. | |

FOREIGN PATENT DOCUMENTS

| | | |
|---|---|---|
| WO | 03-054099 A2 | 7/2003 |

OTHER PUBLICATIONS

Form PCT/ISA/210, International Search Report for International Application No. PCT/US2009/033009, dated Sep. 1, 2009, 3 pages.
Form PCT/ISA/237, Written Opinion of the International Searching Authority for International Application No. PCT/US2009/033009, dated Sep. 1, 2009, 3 pages.

* cited by examiner

*Primary Examiner*—Richard E Chilcot, Jr.
*Assistant Examiner*—Chi Q Nguyen
(74) *Attorney, Agent, or Firm*—Stephan P. Williams; Craig K. Leon

(57) ABSTRACT

Pedestrian trafficable skid-resistant flexible articles are described. These articles include a flexible substrate having a non-skid coating comprising polymer units that degrade upon exposure to light and/or heat, preferably via chain scission. These articles may be applied to trafficable surfaces such as roof and floors. Articles in the form of roof underlayments having a skid-resistant surface are described in particular.

21 Claims, 3 Drawing Sheets

SKID RESISTANT SURFACES

FIELD OF THE INVENTION

The present invention relates to skid-resistant surfaces especially when wet, and in particular to skid-resistant trafficable surfaces such as roofs and floors as well as skid resistant packaging for lumber and the like.

BACKGROUND OF THE INVENTION

Roofing underlayments are typically installed over the roof deck and under the primary roof covering or overlayment, which can be asphalt shingles, metal shingles, or metal roofing, tiles such as Spanish or slate tile, wood shakes, concrete, slate, etc. The underlayment provides a secondary moisture barrier to protect the roof deck and building interior from moisture that may penetrate through the primary roof covering. Commercially effective underlayments must maintain their strength and integrity even after exposure to the elements. Underlayments are used both in new construction and in re-roofing projects.

It is known in the waterproofing art to combine a pre-formed waterproofing membrane, such as a rubberized bitumen/oil layer, with a carrier support sheet or film, and to utilize this as an underlayment. The carrier support film may comprise a variety of materials, such as rubber, plastic, and/or metal, or combinations of the same. The use of metals is desirable, for example, to improve dimensional stability of the support film, which is subjected to oil migration from the oil-plasticized bitumen layer. It has also been desirable to employ cross-laminated plastic films, such as high density polyethylene, for improved stability of the carrier support sheet.

Such pre-formed waterproofing membrane laminates are considered "sheet-like" because they are sufficiently flexible that they can be rolled up and transported after manufacture to the job site where they are unrolled and installed on the building surface. This kind of membrane laminate, useful as an underlayment on sloped roofs, is commercially available from Grace Construction Products (W. R. Grace & Co.-Conn.) under the name "ICE & WATER SHIELD" (a registered trademark of W. R. Grace & Co.-Conn.) The underlayment is applied to the roof deck before installation of the overlayment. The function of the membrane underlayment is to seal around roofing fasteners and to protect against damage from ice dams and wind-driven rain. Another commercially available example of an underlayment is "TRI-FLEX 30", (a product also available from Grace Construction Products) which is spun-bonded polypropylene coated with a thin layer comprising U.V. stabilized polypropylene on both of its surfaces.

In addition to its water shedding capabilities, an important characteristic of a roofing underlayment is its skid or slip resistance. Since roofing applicators must walk on the underlayment during roofing installation, the exposed surface should have a sufficiently high coefficient of friction, even when wet, so as to minimize or prevent an applicator from slipping when walking or standing on the surface. Skid resistant underlayments are disclosed, for example, in U.S. Pat. No. 5,687,517, U.S. Pat. No. 6,308,482, US 2003/0215594, US 2004/0127120 and US 2007/0044397. Other types of membranes or sheets containing particles or filler materials of various types are disclosed, for example, in US 2004/0192130, U.S. Pat. No. 5,496,615, U.S. Pat. No. 4,994,328 and U.S. Pat. No. 6,500,520.

It is also desirable that the roofing underlayment be rollable for ease of transportation and handling, and be readily unrollable, ideally by a single person, for application. However, maintaining unrollability while providing sufficient skid resistance can be problematic, particularly where the skid resistance is due to the tackiness or stickiness of the walking surface. That is, the same tackiness that is advantageously used to provide skid resistance can make it difficult or impossible to unroll the underlayment, particularly if the unrolling is to be carried out by only one person.

It is also desirable that the underlayment be light in weight, i.e. low weight per unit area. Lightweight provides for easier transportation to the roofdeck and easier installation. Some underlayments comprise a heavy layer of a large particulate that provides for a heavyweight membrane. It therefore would be desirable to provide a lightweight roofing underlayment having excellent skid resistance while maintaining unrollability.

Furthermore, it is desirable that good skid resistance is maintained or even improved after exposure outdoors to the degradative effects of UV and thermal oxidative exposure. Roofing underlayments may be expose for 6 months or more prior to application of a wearing surface such as shingles. During this period the underlayment will be exposed to sunlight and the temperature of the membrane may reach as high as 180° to 220° F. (82°-104° C.) for a dark colored membrane or 120° to 140° F. (49°-60° C.) for a highly reflective white membrane.

SUMMARY OF THE INVENTION

One embodiment of the invention is a pedestrian trafficable skid-resistant flexible article, particularly a roofing underlayment. The article is adapted to be stored in a roll and unrolled prior to application to a surface. The article comprises a flexible substrate suitable for application to a roof, floor or package, wherein the substrate has a first major surface adapted to contact the roof, floor or package and an opposite second major surface adapted to be exposed to pedestrian traffic. The second major surface has an elastomeric non-skid coating comprising polymer units that degrade (or break) via chain scission over time upon exposure to light (e.g., UV-light) and/or temperatures of about 100° to about 220° F. (about 38° to about 104° C.).

In another embodiment, the elastomeric non-skid coating preferably comprises a pressure sensitive adhesive that includes polymer units that degrade (or break) via chain scission over time upon exposure to light and/or temperatures of about 100° to about 220° F. (about 38° to about 104° C.). In a further embodiment, the elastomeric non-skid coating may optionally, and preferably, include inorganic filler particles, wherein the inorganic filler particles are substantially coated with the elastomeric non-skid coating. In an additional embodiment, the article is in the form of a roofing underlayment and, preferably, the roofing underlayment is colored (e.g., white to light gray or light blue) to be substantially reflective to highly reflective. "Substantially reflective" means that the surface reflects at least 50% of incident light.

In another embodiment of the invention, the skid-resistant flexible article is in the form of a lightweight roofing underlayment having excellent skid or slip-resistance to foot traffic under dry, wet and/or dusty conditions on a sloped surface, and is both readily rollable and unrollable as a coherent unit. The underlayment is preferably a multi-layered sheet material that includes a support layer comprised of a film or fabric or both, and a non-skid coating on one or both faces of the support layer. The non-skid coating comprises polymer units that degrade via chain scission upon exposure to light (typically UV-light) and/or temperatures of about 100° to about 220° F. The non-skid coating optionally includes inorganic filler particles, wherein the filler particles are substantially coated with the organic components (i.e., polymer composition) that comprise the non-skid coating. The resulting sheet-like underlayment is sufficiently flexible to allow it to be formed into rolls and readily installed by unrolling over a support structure such as a roof deck. It also provides a sloped walking surface having a high coefficient of friction and excellent skid resistance even when wet and/or dusty, and even at high roof pitches such as those between about 4:12 and 12:12. Furthermore good skid resistance is maintained after outdoor exposure.

In its method aspects, the present invention relates to a method of forming a skid-resistant flexible article useful for example as a roofing underlayment by coating a thin layer of an elastomeric non-skid coating (as described herein) onto a flexible substrate that may include a support layer such as a film or fabric. In addition, the present invention includes a method of waterproofing a roof or floor by unrolling the above-described skid resistant flexible article and applying it to the roof or floor such as by mechanical fastening or with an adhesive.

The present invention also includes a method of making a pedestrian trafficable skid-resistant flexible article comprising providing a flexible substrate suitable for application to a roof, floor or package, said substrate having a first major surface adapted to contact said roof, floor or package and an opposite second major surface adapted to be exposed to pedestrian traffic; coating said second major surface with a non-skid coating (as described herein) in a solvent; and evaporating the solvent from said non-skid coating. Preferably, the non-skid coating will include inorganic filler particles that are substantially coated by the organic components that comprise the non-skid coating.

Another embodiment of the invention is an organic or inorganic roofing felt coated with a non-skid coating as described herein. An additional embodiment of the invention is a roof decking comprising plywood or other decking material such as oriented strand board coated with a non-skid coating as described herein.

DETAILED DESCRIPTION OF THE PREFERRED EMBODIMENTS

One embodiment of the invention is a skid-resistant flexible article comprising a flexible substrate coated with an elastomeric non-skid coating (or skid resistant layer) that is skid resistant particularly when wet and after outdoor exposure. The elastomeric non-skid coating preferably comprises polymer units that degrade (or break) via chain scission over time upon exposure to light (e.g., UV-light) and/or temperatures of about 100° to about 220° F. (about 38° to about 104° C.). The elastomeric non-skid coating may optionally include inorganic filler particles, wherein the inorganic filler particles are substantially coated with the organic components of the elastomeric non-skid coating. The article is suitable for application to a pedestrian trafficable surface such as a roofing surface or a flooring surface. Articles suitable for roofing surfaces include rollable roofing underlayments including synthetic polymeric mechanically attached underlayments, synthetic polymeric adhesively attached underlayments, organic and inorganic asphalt saturated roofing felts, liquid-applied roofing surfaces including urethanes, asphaltic-based materials, acrylics, and silicones, etc. Articles suitable for roofing surfaces further may be rollable exposed roofing membranes including rubber sheets, vinyl sheets, and TPO sheets. Flooring surfaces include wood-based materials, Portland cement-based materials, ceramic materials, naturally occurring stone materials, and synthetic polymeric materials as well as composite materials containing combinations of the foregoing.

Figure 1:
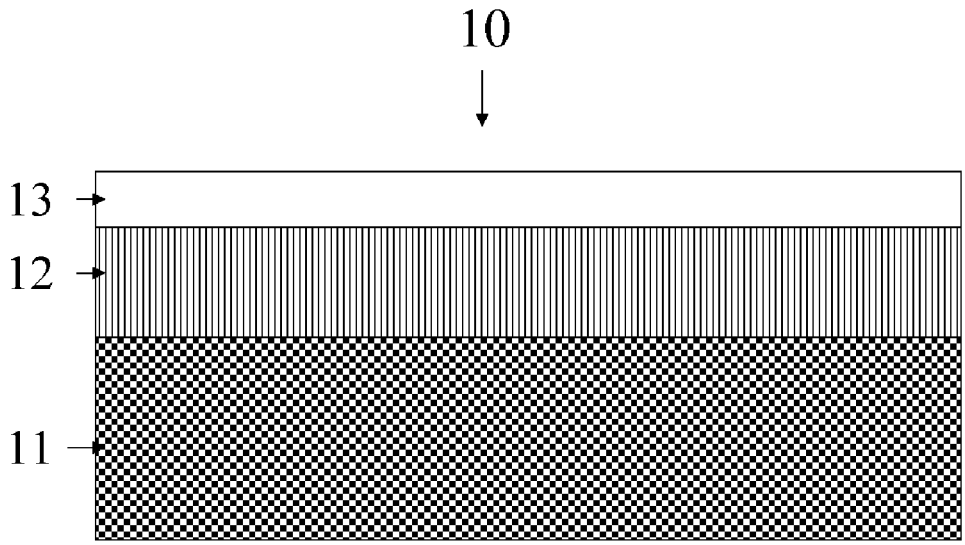
FIG. 1 is a schematic diagram of a roofing underlayment in accordance with one embodiment of the present invention.

Turning first to FIG. 1, there is shown one embodiment of the article of the present invention in the form of roofing underlayment 10. The underlayment 10 has an uppermost layer 13 of the non-skid coating (or skid-resistant layer) of the invention supported by a flexible substrate or support layer which can be one or more layers of a film or fabric, or both. In the embodiment shown in FIG. 1, the support layer is comprised of a lowermost layer 11 of fabric and an intermediate layer 12 of film. Suitable films 12 are those comprised of a synthetic organic polymer such as a polyolefin or a blend of polyolefins, and films mentioned as suitable for this layer hereinafter. The preferred film is polypropylene or polyethylene or films made from mixtures of such. The present invention also contemplates the use of more than one film layer, such as layers laminated and/or co-extruded or cross-laminated together. Those skilled in the art will appreciate that the underlayments can be produced by any method known in the art such as extrusion, lamination and calendaring. The film layer 12 has a thickness in the range from 0.5 mils to 10 mils (0.013 mm to 0.25 mm). Preferably, the thickness is in the range from 1 mil to 3 mils (0.025 mm to 0.076 mm).

Suitable fabrics for use in the support layer 11 include both natural and synthetic woven and non-woven fabrics, and preferably is synthetic such as a polyolefin, such as polypropylene or polyethylene, a polyester, etc., or glass. Preferably the woven fabric has less than or equal to 25 percent open space. Woven and non-woven fabrics exhibit a weight ranging from 0.5 oz/yd$^2$ (16.9 g/m$^2$) to 10 oz/yd$^2$ (339 g/m$^2$). Preferably, woven and non-woven fabrics exhibit a weight in the range from 1 oz/yd$^2$ (33.9 g/m$^2$) to 3 oz/yd$^2$ (102 g/m$^2$).

In the particular embodiment of FIG. 1, the flexible substrate includes a support layer comprised of (i) a non-woven or woven fabric layer 11, and (ii) a synthetic organic polymer film 12 attached to one surface of the fabric 11. On the surface of the synthetic organic polymer film 12 is an elastomeric non-skid coating (or skid-resistance layer) 13, which comprises polymer units that degrade via chain scission upon exposure to light and/or temperatures of about 100° to about 220° F. (about 38° to about 104° C.). The elastomeric non-skid coating may optionally include inorganic filler particles that are substantially coated with the organic components that comprise the non-skid coating. It is this skid-resistant layer 13 that provides the walking surface for the roof applicator, and is ultimately covered by the primary roof covering or overlayment such as shingles or tiles.

In the case where fabric layer 11 is a non-woven fabric, it may be comprised of one or more synthetic organic polymers such as polyolefins, for example polypropylene or polyethylene, or may be comprised of polyester. Polypropylene is preferred. Where fabric layer 11 is a woven fabric, it may be comprised of one or more one or more synthetic polymers such as polyolefins, for example polypropylene, or polyethylene, or may be comprised of polyester. The fabric may also comprise a woven or non-woven glass fiber mat. Fabrics comprised of polypropylene are preferred for use in the embodiment shown in FIG. 1.

The synthetic polymer film 12 comprises one or more polymers such as polyolefins, for example polypropylene, polyethylene, a polymer comprising ethylene and propylene, a polymer comprising ethylene and methyl acrylate, a polymer comprising ethylene and ethyl acrylate, a polymer comprising ethylene and butyl acrylate, a polymer comprising ethylene and an alpha olefin, a polymer comprising ethylene and vinyl acetate or polyester, and includes mixtures of the foregoing. Polyethylene, polypropylene, and mixtures of the two are preferred. The synthetic polymer film 12 may also be a coextruded film layer (not shown as such in FIG. 1). Each layer may comprise one or more of the polymers listed above.

The laminate comprising the non-woven or woven fabric 11 attached to a synthetic organic polymer film 12 may be manufactured by extrusion coating the layer 12 as a polymer melt onto the fabric.

The elastomeric non-skid coating 13 generally comprises an elastomeric polymer composition, preferably an elastomeric polymer composition with the characteristics of a pressure sensitive adhesive. The elastomeric polymer composition may comprise a polymer, a copolymer or a mixture of polymers or copolymers. The elastomeric polymer composition will comprise a certain proportion of polymer units that are capable of degrading (or breaking) via chain scission over time upon exposure to light (particularly UV-light) and/or temperatures of about 100° to about 220° F. (about 38° to about 104° C.). Preferably, the elastomeric polymer composition will comprise (in mole percent) about 0.1% to about 10%, more preferably about 0.5% to about 5%, of polymer units that are capable of degrading (or breaking) by chain scission over time. Of course, a higher proportion of such polymer units is possible, up to about 30 mole %, depending upon the rate and mechanism of degradation and the other components of the polymer composition. The non-skid coating may optionally include inorganic filler particles that are substantially coated with the polymer composition that comprises the non-skid coating.

Without being bound by any theory, it is believed that the inclusion in the polymer composition of a select proportion of polymer units that degrade over time by chain scission causes a slight reduction in the overall molecular weight of the polymer composition over time upon exposure to light and/or heat. This reduction in molecular weight causes plasticization of the non-skid coating and tends to increase the tack of the non-skid coating. Ideally, the rate of degradation or breaking of polymer units should counterbalance, and preferably exceed, the rate of any coupling of polymer units that may be simultaneously occurring as a result of such light/heat exposure. The rate of change in tack with outdoor exposure may be controlled by proper selection of the polymer units that degrade by chain scission, the mole percent of such polymer units in the polymer composition, and the selection of other polymers in the polymer composition.

Preferably, the elastomeric non-skid coating will comprise an elastomeric polymer composition that includes polymer units that contain a carbon-carbon double bond (—C═C—) in the main chain that is capable of degrading or breaking upon exposure to light and/or heat. More preferably, the polymer composition will include isoprene polymer units, e.g., polymers of isoprene alone or as a copolymer with other monomers. The isoprene unit of a polymer is known to exhibit degradation via chain scission. A most preferred polymer composition for the non-skid coating includes elastomers comprising isoprene. Elastomers comprising isoprene may include natural rubber, synthetic polyisoprene, butyl rubber, halogenated butyl rubbers, and SIS (styrene-isoprene-styrene block copolymers). A highly preferred elastomeric polymer composition comprises a copolymer of isobutylene and isoprene, particularly where the copolymer comprises about 0.1 mole % to about 10 mole %, preferably about 0.5 mole % to about 5 mole %, isoprene.

The non-skid layer is formulated to exhibit good initial wet and dry skid resistance and good wet and dry skid resistance after outdoor exposure. For good initial skid resistance, the organic solids portion of the non-skid layer is formulated to exhibit theological properties that range from those for an uncured (not vulcanized) elastomer to those for a pressure sensitive adhesive. The materials exhibit a level of tack that ranges from slight to significant that provides for adhesion between the non-skid surface and the shoe sole of an individual walking on the non-skid surface. In addition to a polymer(s) that degrades by chain scission upon exposure to light and/or heat, the polymer composition of the non-skid coating may comprise other elastomers, tackifiers, and plasticizers.

The polymer(s) that degrades by chain scission provides for good wet and dry skid resistance after outdoor exposure by increasing the tack of the non-skid layer. Chain scission reduces the molecular weight of the polymer. The net effect is the plasticization of the non-skid coating that causes an increase in tack. The rate of change in tack with outdoor exposure may be controlled by proper selection of the polymer that degrades by chain scission and the mole percent of such polymer in the polymer composition (e.g., the polymer comprising isoprene and or combination of a polymer(s) comprising isoprene with polymers that do not comprise isoprene.)

The most preferred non-skid coating comprises butyl rubber as the main component of the polymer composition and a small proportion of polyisoprene as the polymer unit that degrades upon exposure to light and/or heat. Exxon butyl 065 is most preferred. It comprises 1 mole % isoprene copolymerized with isobutylene. Other butyl rubbers that may be used include those comprising 0.1 mole % to 10 mole % isoprene, preferably 0.5 mole % to 5 mole % isoprene. These are available from Exxon Corp.

Isoprene containing elastomers like natural rubber, synthetic polyisoprene, butyl rubber, halogenated butyl rubbers, and SIS (styrene-isoprene-styrene block copolymers) may be blended with one another. Alternatively, elastomers comprising isoprene may be blended with elastomers that do not comprise isoprene. Preferably, the blends are compatible in that they are miscible with one another forming a single phase. Options for elastomers that do not comprise isoprene include polyisobutylene, SBS (styrene-butadiene-styrene block copolymers), SEBS (styrene-ethylene-butylene-styrene block copolymers), SBR (styrene-butadiene rubber), silicone rubber, chloroprene, ethylene-propylene rubber, ethylene alpha olefin polymers, polybutadiene, nitrile rubbers, and acrylic rubbers.

Skid-resistant articles where the non-skid coating comprises butyl rubber generally exhibit the best skid resistance after outdoor exposure if the article surface is substantially reflective to highly reflective. Such reflective articles may be pigmented white to off white or light gray or light blue. The most reflective surface would reflect 100% of incident light. Preferred articles of the present invention reflect 50% to 100% of incident light, most preferably 75% to 100% of incident light. Reflectance is measured according to ASTM C1549 using a portable specular reflectometer, such as, for example, D&S Portable Specular Reflectometer Model 15R distributed by Devices and Service Co., Dallas, Tex.

The non-skid article of the present invention becomes tacky (or maintains its tackiness) after direct exposure to sunlight. After long term exposure to sunlight, tack may diminish somewhat. Substantially reflective articles remain tacky longer after direct exposure to sunlight than a similar article with a less reflective surface, such as one pigmented grey to black. The substantially reflective article may reach a maximum temperature in the vicinity of 120° F. when exposed to direct sunlight, whereas a non-reflective (black) article may reach a maximum temperature in the vicinity of 200° F. when exposed to direct sunlight.

While not being bound by any theory, it is believed that the butyl rubber containing a small proportion of isoprene degrades predominantly by chain scission at the lower exposure temperatures for substantially reflective to highly reflective articles, providing for persistence of tack (and even some increase in tack) over a long period of time. At the higher exposure temperatures encountered for less reflective articles, the mechanism and/or rate of degradation is such that tack does not generally persist for as long a period of time. Chain scission and coupling are competitive degradation mechanisms. The former results in an increase in tack and the latter results in a decrease in tack. At the lower exposure temperatures for substantially reflective articles, chain scission may predominate. Alternatively, chain scission may predominate initially as a function of exposure time only to be displaced by coupling after longer exposure times. (See, for example, Chandra, Ramesh and Bhatnagar, Hari L. (Dep. Appl. Sci. Humanities, Kurukshetra Univ., Kurukshetra, India) "Kinetics of the Photooxidative Degradation of Butyl Rubber by Light Scattering," Indian Journal of Chemistry, Section A: Inorganic, Physical, Theoretical & Analytical (1976), 14A(7), 469-73. CODEN: IJCADU ISSN: 0376-4710. CAN 85:193859 AN 1976:593859 CAPLUS (Copyright© 2006 ACS on SciFinder®) Thus, a preferred non-skid article according to the invention will have a substantially reflective non-skid coating.

The non-skid coating may optionally include a plasticizer, which is generally a low molecular weight ingredient that is compatible with the polymer composition (e.g., a naphthenic or aliphatic oil). A plasticizer lowers the plateau modulus of a mixture of rubber and plasticizer vs. the rubber alone. The non-skid coating may optionally include a tackifier, which is generally a low molecular weight ingredient (e.g., a C5 or C9 hydrocarbon resin) that is compatible with the polymer composition and increases its glass transition temperature. A tackifier also lowers the plateau modulus of the rubber plus tackifier blend vs. the rubber alone. These features are known to those skilled in the art of pressure sensitive adhesive formulation.

Preferred non-skid coatings of the present invention will include a tackifier. The preferred tackifiers are hydrogenated resins and aliphatic resins. The most preferred tackifiers are produced by Eastman Chemical under the tradename of Regalrez. These are manufactured by selective hydrogenation of base resins polymerized using styrene-based comonomers. These include Regalrez 1085 and 1094. Also preferred are resins produced by hydrogenation of petroleum feedstocks. These are produced by Eastman Chemical under the tradename Eastotac. Also preferred are aliphatic resins manufactured by Eastman Chemical under the tradename Piccotac. Preferably, the weight ratio of polymer composition (e.g., butyl rubber containing polyisoprene units) to tackifier will be about 4:1 to 1:3, most preferably about 3:1 to 2:1.

For embodiments of the invention where the non-skid coating 13 does not include inorganic filler particles, the non-skid coating 13 may be less than or equal to about 10 μm thick, more preferably less than or equal to about 5 μm thick (typically about 0.5 μm to about 5 μm thick). Such a thin layer insures good skid resistance, including wet skid resistance, while maintaining the ability to unroll the membrane and insure that a pedestrian does not stick to the surface while walking on it. The ability to unroll and/or to prevent too much adhesiveness is measured using an accelerated blocking test as described in Example 1. Following this test, one can measure the blocking level as a peel force in pounds per square inch (pli). It is preferred that coatings of the present invention have a blocking level of less than 1 pli, preferably about 0.5 pli or less (e.g., 0.05 to 0.5 pli).

For embodiments where the non-skid coating 13 is a pressure sensitive adhesive, the pressure sensitive adhesive exhibits a minimum peel adhesion value of 1 pound per linear inch (pli) to the support sheet. Adhesion is measured by applying a one inch wide tape comprising a 5 mil (0.13 mm) layer of the pressure sensitive adhesive laminated to the face of a 4 mil (0.10 mm) thick cross-laminated, high density polyethylene sheet such as "Valeron", a commercial product of Valeron Strength Films, to the substrate. This "tape" may be prepared by coating the pressure sensitive adhesive from solution and drying, or coating the molten pressure sensitive adhesive at elevated temperature onto the 4 mil Valeron. The face of the pressure sensitive adhesive side of the one inch wide tape is applied to the substrate. The construction is rolled in four times in one second passes with a 30 pound roller. Adhesion is measured fifteen minutes later with a mechanical test device such as an Instron using a peel angle of 90 degrees and a cross-head speed of 2 in./min.

The non-skid coating 13 may optionally include inorganic filler particles. The term "particles" as used herein is intended to encompass particles having regular (e.g., spherical) or irregular shapes, as well as shards. The inorganic filler particles provide for a textured surface. The textured surface enhances skid resistance by providing a mechanical interlock with the shoe sole of the individual walking on a non-skid surface of the present invention. The textured surface also enhances the ability to unroll an underlayment or other rollable non-skid product by decreasing the contact area, in rolled form, of the top side of the membrane with the backside of the membrane vs. the situation for a non-skid surface of the present invention that does not comprise inorganic filler particles.

The filler particles are preferably substantially coated with the non-skid coating material (i.e., the elastomeric polymer composition), thus providing a textured surface. "Substantially coated" means that at least about 95 percent of the filler particle's surface is coated. More preferably, substantially coated means that at least 98%, and most preferably at least 99%, of the filler particles within a selected area (e.g., 100 $cm^2$) are completely coated or encapsulated by the coating material. By "textured" is meant that the filler particles protrude from the surface and, thus, the surface coating is uneven (or textured) rather than being smooth or planar. Such texturing would be clearly visible in SEM photomicrographs. The filler particles are substantially coated with the polymer composition as a result of the preferred manufacturing process. This process involves producing a coating comprising the polymer composition, the filler particles, and a solvent that dissolves the polymer composition, applying the coating to a substrate, and removing the solvent by evaporation thereby depositing a layer of coating containing the encapsulated filler particles onto the substrate.

Inorganic filler particles are included in an amount of at least about 25 percent by volume of the non-skid coating, preferably in an amount of at least about 33 percent by volume, more preferably in an amount of at least about 45 percent by volume, most preferably at least 50% by volume. Use of a high filler volume, including amounts up to about 75%, insures that the non-skid layer is textured. A range of about 30% to 60% filler by volume is ideal. If the filler volume is too low, the layer is relatively smooth.

The filler has a maximum average particle size of up to about 100 ∞m. Preferably the filler has a maximum average particle size of less than about 50 μm. More preferably the filler has a maximum average particle size of up to about 25 μm. Filler particles in the range of about 0.1 μm to about 20 μm, preferably about 0.5 μm to about 15 μm, are ideal. Larger particle sizes hinder the coating application process, and add excessive weight to the underlayment. Suitable inorganic fillers include calcium carbonate, silica, clay, talc, vermiculite, mica, titanium dioxide, fly ash, alumina trihydrate, and slag. Calcium carbonate is preferred. The fillers may be surface treated with a bonding agent to enhance bonding to the binder and ease of dispersion in the solvent. Optional bonding agents include silanes, titinates, and long chain acids like stearic acid. In addition a dispersant may be used to aid in the dispersion of filler particles in the solvent.

The coating volume of the filled non-skid coating layer is up to about 10 cubic centimeters per square foot ($cm^3/ft^2$) (107.6 $cm^3/m^2$), preferably less than about 5 $cm^3/ft^2$ (53.8 $cm^3/m^2$), more preferably less than about 2 $cm^3/ft^2$ (21.5 $cm^3/m^2$), and most preferably less than about 1 $cm^3/ft^2$ (10.8 $cm^3/m^2$). An ideal volume is 0.1 to 1 $cm^3/ft^2$ (1.08 to 10.8 $cm^3/m^2$).

Inorganic particulates that react with water may also be used. These include Portland cement, calcium oxide, high-alumina cement, blast furnace slag, pozzolanas, and pozzolanic cement. These fillers may hydrate after the underlayment is installed on the roof deck. The net effect is an increase in the average size of the particulate after the membrane is installed.

Preferred underlayments will have a non-skid coating that includes inorganic filler particles, particularly calcium carbonate filler particles. In addition, the preferred underlayments will have a surface that is substantially reflective to highly reflective. In a highly preferred embodiment, the non-skid coating will comprise a polymer composition that comprises a butyl rubber, more preferably a butyl rubber that comprises from 0.5 mole % to 5 mole % polyisoprene.

The non-skid coating 13 is preferably coated as a solution in an organic solvent (for the polymer composition). For example, a coating solution comprising the polymer composition (including any desired tackifier(s) and/or plasticizer(s), inorganic filler particles and an organic solvent is coated onto a flexible substrate comprising the support layer, and the solvent is removed by evaporation to leave the non-skid coating. The coating solution may be applied to the substrate by brush, roller, or spray application, and may be a continuous process such as spray, roll coating, gravure coating, knife coating, and wire wound rod coating (i.e., Meyer rod coating). Wire wound rod coating is preferred, where the diameter of the wire wrapped around the metering rod, sometimes known as a "Meyer Bar", permits the desired quantity of the coating to remain on the substrate. The resulting coated substrate can then be wound into a roll. Suitable organic solvents include those that will completely dissolve the organics and also exhibit a high vapor pressure so that evaporation can be affected quickly in the coating process. For example, hydrocarbon solvents such as heptane may be used. Other useful solvents include methyl ethyl ketone and toluene. It is also contemplated that the coating solution may be applied as an aqueous emulsion.

Another embodiment of the invention includes a skid resistant flexible article in the form of a roofing underlayment comprising a woven fabric, a non-woven fabric, a film, or a combination of these and a non-skid coating as previously described. A preferred underlayment comprises a spun bonded polypropylene substrate, both sides of which have been extrusion coated with a polyolefin, and an underlayment comprising a woven fabric that is laminated to a polyolefin film.

Figure 2:
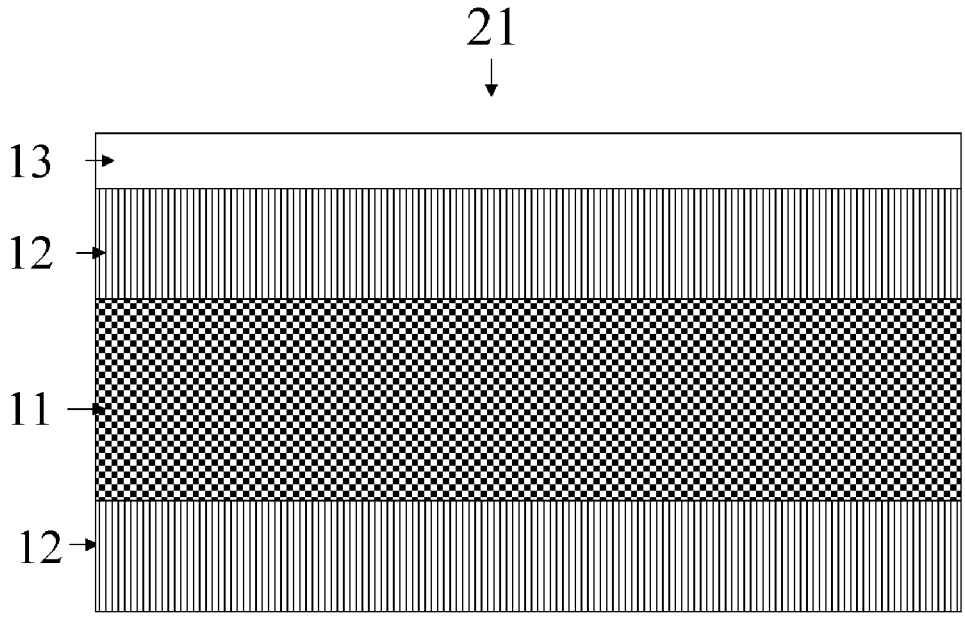
FIG. 2 is a schematic diagram of a roofing underlayment in accordance with another embodiment of the present invention.

FIG. 2 illustrates a second embodiment of the present invention. The underlayment 21 comprises a non-woven or woven fabric layer 11, a synthetic organic polymer film layer 12 adhered to both faces of the fabric 11, and a non-skid coating 13 on the surface of the polymer film 12. The polymer film 12 may be a coextruded layer (not shown) polymer film.

Figure 3:
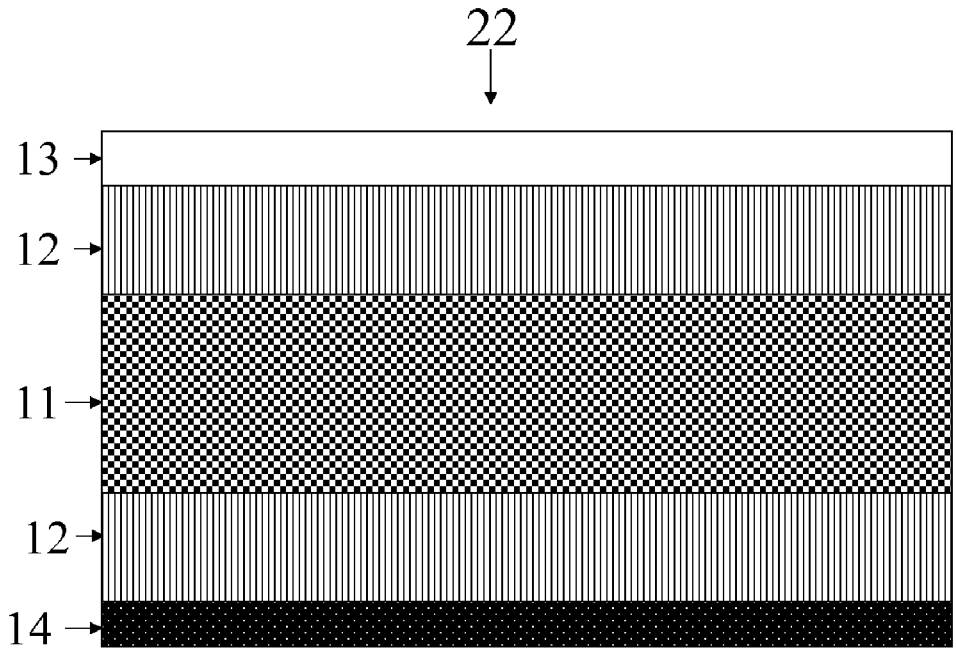
FIG. 3 is a schematic diagram of a roofing underlayment in accordance with yet another embodiment of the present invention.

Yet another embodiment is shown in FIG. 3, where the underlayment 22 comprises a non-woven or woven fabric 11, a synthetic organic polymer film 12 adhered to both faces of the fabric 11, a non-skid coating 13 on the surface of one of the polymer film layers 12, and a further non-skid layer 14 (preferably an extrusion coated layer) on the surface of the other polymer film layer 12. The non-skid layer 14 can minimize or prevent relative movement between the underlayment and the roofing deck during and after installation. Suitable non-skid layers 14 include one or more polyolefins such as polyethylene, polypropylene, a polymer comprising ethylene and propylene, a polymer comprising ethylene and methyl acrylate, a polymer comprising ethylene and ethyl acrylate, a polymer comprising ethylene and butyl acrylate, a polymer comprising ethylene and vinyl acetate, a polymer comprising ethylene and an alpha olefin, and a polymer comprising ethylene and octene. The non-skid layer 14 preferably has a thickness of less than about 1 mil (0.0254 mm), and exhibits a Shore D hardness, ASTM D2240, of less than about 45.

The multi-layer synthetic organic polymer film 12 and 14 in FIG. 3 may be co-extrusion coated onto the fabric 11 to produce a structure comprising layers 11, 12 and 14 of underlayment 22. Synthetic polymer layer 12 is extrusion coated to the other face of fabric 11. This may also be a coextruded layer (not shown). The non-skid coating 13 then may be applied to such structures to produce the underlayment of FIG. 3 by coating, as a mixture with an organic solvent that dissolves the organic portion of the coating, onto a web comprising a support in a continuous web coating operation. The solvent is removed by evaporation and the resulting underlayment is wound into rolls. Various types of coaters may be used to apply the organic solvent based coating, including wire wound rod (also called Meyer rod), roll coater, gravure coater, air knife, and a knife over roll coater.

Figure 4:
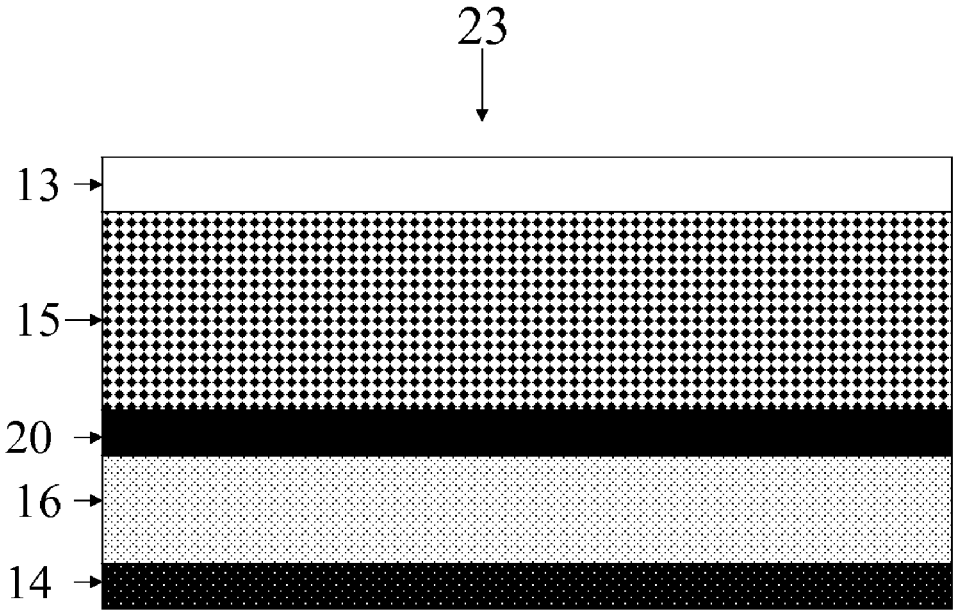
FIG. 4 is a schematic diagram of a roofing underlayment in accordance with still another embodiment of the present invention.

FIG. 4 illustrates a further embodiment 23 that comprises a woven fabric layer 15 with less than or equal to 25 percent open space, a non-skid coating 13, a lamination layer 20, a polymer film 16 and a second non-skid layer 14. Layer 15 comprises a material selected from polyethylene, polypropylene, polyester, or glass. The weight of layer 15 is 0.5 $oz/yd^2$ to 10 oz/yd$^2$ (16.9 g/m$^2$ to 339 g/m$^2$). Preferably, the weight of layer 15 is 1 oz/yd$^2$ to 3 oz/yd$^2$ (33.9 g/m$^2$ to 102 g/m$^2$). Options for materials for layer 14 are described above. Layer 16 is a polymer film comprising one or more materials selected from the group including polypropylene, polyethylene, a polyolefin, or polyester. The thickness of layer 16 is 0.5 mils to 10 mils (0.013 mm to 0.254 mm). Preferably the thickness of layer 16 is 1 to 3 mils (0.025 mm to 0.076 mm). Polypropylene is preferred. Layer 20 adheres layer 15 to layer 16. Layer 20 may comprise the same materials as previously described above for layer 12. The film layer 20 has a thickness in the range from 0.5 mils to 10 mils (0.013 mm to 0.254 mm). Preferably, the thickness of layer 20 is in the range of 1 to 3 mils (0.025 mm to 0.076 mm).

Layer 20 may also comprise a pressure sensitive adhesive. Layer 20 may also comprise bitumen. Layer 20 may also comprise rubber and bitumen. For the case where layer 20 comprises a pressure sensitive adhesive, bitumen, or bitumen and rubber, the thickness is in the range from 1 mil to 50 mils (0.025 mm to 1.27 mm). For the case where layer 20 comprises a pressure sensitive adhesive, bitumen, or bitumen and rubber the underlayment 23 exhibits nail sealing characteristics, i.e. the material of layer 20 tends to seal around nails that are made to penetrate the underlayment 23.

The underlayment 23 of FIG. 4 may be made in several ways. In a preferred process, a coextruded film comprising layers 14 and 16 is made via a coextrusion process. Next the coextruded film 14/16 is laminated to woven fabric 15 via extrusion lamination with lamination layer 20. A coating comprising solvent and a polymer composition in accordance with the invention as previously described (optionally containing inorganic filler particles) is coated on to the other face of woven fabric 15, and the solvent is removed via evaporation leaving non-skid coating layer 13.

Figure 5:
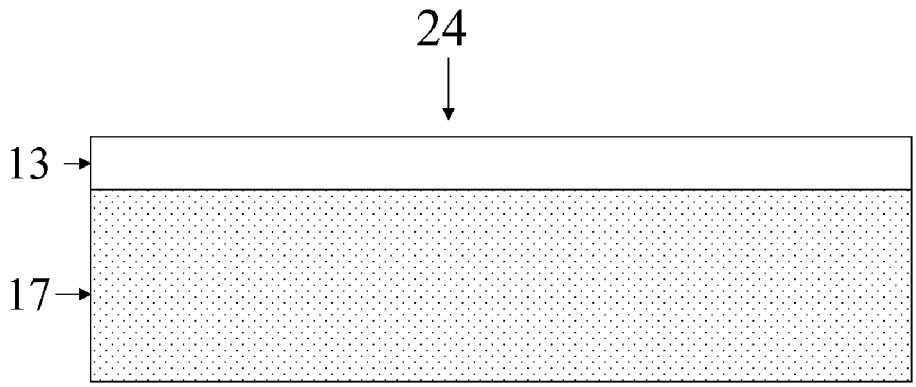
FIG. 5 is a schematic diagram of a roofing underlayment in accordance with a still further embodiment of the present invention.

The embodiment 24 of FIG. 5 shows a polyethylene or polypropylene film 17, and a non-skid coating 13 on one face thereof. Cross-laminated films are preferred, such as cross-laminated films commercially available from Van Leer under the trademark VALERON. Other suitable cross-laminated films are those manufactured by Interplas/Formosa.

Another embodiment of the invention (not shown) is an organic or inorganic roofing felt coated with a non-skid coating of the present invention. An organic roofing felt comprises paper saturated with asphalt. An inorganic roofing felt comprises a non-woven glass fabric saturated with asphalt.

Figure 6:
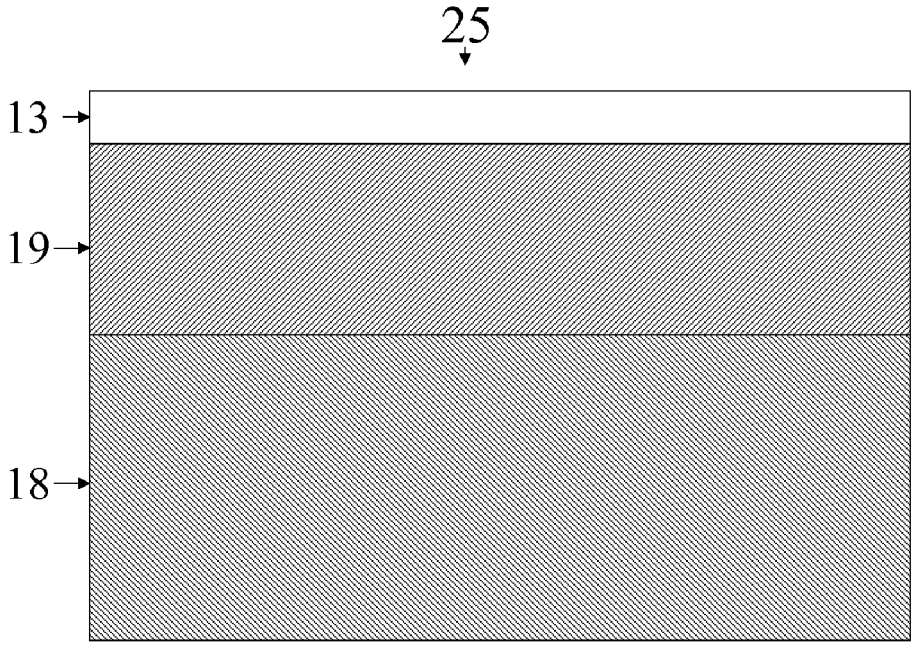
FIG. 6 is a schematic diagram of a roofing underlayment in accordance with yet another embodiment of the present invention.

FIG. 6 illustrates an embodiment 25 of a self-adhering roofing underlayment comprising a support layer 19, a non-skid coating 13 on one major surface thereof, and a second pressure sensitive adhesive 18 on the opposite major surface thereof. The pressure sensitive layer 18 may include rubber modified bitumen, and non-bituminous adhesives comprising rubbers such as SIS, SBS, SEBS, SBR, natural rubber, silicone, butyl rubber, isoprene, butadiene and acrylic rubber. Preferably the layer 18 is used in a thickness of greater than or equal to 5 mils (0.13 mm), more preferably greater than or equal to 20 mils (0.51 mm). The support layer 19 comprises a film, a woven fabric, a non-woven fabric, or a combination of these. Preferably, the films comprise a polyolefin, polyethylene, polypropylene, a polyester, or a combination of these materials.

The preferred manufacturing method comprises providing a coating solution comprising a mixture of an organic solvent, a polymer composition as previously described, and optional filler particles, and coating the coating solution onto a flexible substrate (or support layer), then removing the solvent by evaporation. This method is preferred because the filler particles are well bonded to the support sheet in comparison to other manufacturing methods by virtue of being substantially coated with the polymer composition. Other methods may be utilized to coat a non-skid coating on to a support sheet, particularly where the non-skid coating comprises no, or only a low level of, filler particles. For example, the non-skid layer may be coated as a hot melt. Alternatively, the non-skid layer may be coated onto the membrane as an oligomer and or monomer based composition and subsequently cured to a polymer composition. Of course, other underlayments and other roofing products also may be utilized in accordance with the present invention.

Other applications for the non-skid coating are contemplated. The non-skid coating of the present invention may be applied to plywood and oriented strand board. Use of these coated decking materials enhances skid resistance particularly when these materials are used on a sloped roof deck. Another application is non-skid flexible packaging materials. For example, plastic sacks may be coated with the non-skid coating of the present invention to prevent sliding of stacked arrays of products.

Coating compositions may be prepared by a variety of methods with various types of mixers, e.g., horizontal and vertical batch type mixers. Ideally, a medium intensity or high intensity mixer is used, such as, for example, a medium intensity horizontal paddle mixer, a high speed Cowels dissolver, a rotor/stator high speed mixer, and others. An in-line rotor stator mill or an in-line media mill are particularly useful for effectively dispersing filler(s) into the coating material. For coatings comprising only organic solids, first a solvent is charged into a batch type mixer. Then the polymer composition as previously described and other organic ingredients like other elastomers, plasticizers and tackifiers are charged into a batch type mixer and the agitator is turned on. Organic ingredients are metered into the mixer and mixed until dissolved. Alternatively, organic ingredients may be hot melt compounded, formed into blocks or chips, cooled, added to solvent in a batch type mixer, and mixed until dissolved. For coatings that include inorganic filler particles, a solution comprising the organic ingredients may be prepared first followed by filler addition and additional mixing. Alternatively, organic ingredients and filler and adhesive ingredients may be added simultaneously to solvent in a batch mixer. After all ingredients are combined, the mixture of solvent, organic ingredients, and filler may be circulated through an in-line mixer like a rotor stator in-line mixer or a media mill to affect optimal mixing.

Example 1

Skid resistance was measured in a "walk on" test as follows. Underlayment specimens to be tested were mechanically attached to a sheet of plywood and positioned at a test angle of 40°. The samples were tested dry and wet sprayed with water prior to testing. A tester ("walker") walks over the sample and compares the skid resistance of the sample to a "control". The walker judges the skid resistance to be significantly better (+2), moderately better (+1), the same (0), moderately worse (−1), or significantly worse (−2) than the control. Three to 4 walkers are used for each comparison. Average values are reported.

For all tests a membrane with the construction depicted in FIG. 3 was used for the tests. Layer 11 is a 60 to 80 g/m$^2$ woven polypropylene mesh. Layers 12 comprise 20 to 35 g/m$^2$ extrusion coated polyolefins. For some samples top layer 12 is pigmented grey. For other samples top layer 12 is pigmented white. Layer 14 comprises 5 to 10 g/m$^2$ of an ethylene-ethylacrylate copolymer. Layer 13 is the non-skid layer and various formulations were evaluated. The approximate coating weight is 10 g/m$^2$. All coatings comprise the elastomeric polymer composition and inorganic filler particles. Four formulations were evaluated. One formulation comprises only Exxon butyl 065. A second formulation comprises an acrylic pressure sensitive adhesive, Acrynax 10127, produced by Schenectady International. The third formulation is shown below:

| | Weight Fraction |
|---|---|
| Irganox 1010 (antioxidant) | 0.504 |
| Tinuvin 328 | 0.504 |
| Regalrez 1018 (liquid tackifying resin) | 22.704 |
| Regalrez 1085 (crystalline tackifying resin) | 34.6 |
| Indopol 6000 (high molecular weight polybutene as plasticizer) | 10 |
| Oppanol B10 | 6.64 |
| Butyl 065 (UV) (butyl rubber) | 10 |
| Kraton G 1924 (maleic anhydrite grafted SEBS) | 15 |

The fourth formulation comprises Exxon butyl 065 and a hydrocarbon tackifier, Regalrez 1085, in a weight ratio of 3:1. All formulations include fine particle calcium carbonate at a 3:1 weight ratio of inorganic filler to organic solids or a 3:2 weight ratio of inorganic filler to organic solids. Some formulations also comprise titanium dioxide, a UV absorber, and/or an antioxidant. The control formulation for grey samples comprises the third formulation, above, a 3:1 filler: organic solids ratio and no other ingredients. The control sample was not exposed outdoors (unaged). The control formulations for white samples are their unaged counterparts.

Formulations and results of skid resistance measurements are shown in the table below.

dient exhibit substantially better skid resistance after outdoor exposure than all other formulations. Even though the third formulation comprises a low level, 10%, of butyl 065, it is not enough to offset the deleterious effects of the other ingredients on aged skid resistance. The formulation comprising butyl 065 and Regalrez (3:1) also has good skid resistance after ageing although the wet skid resistance is not as good as for formulations comprising only butyl 065 as the polymer composition.

Example 2

Accelerated ageing tests, EMMAQUA, were conducted as well. The test is run by DSET laboratories. Samples were exposed to 28 mj, 84 mj, and 168 mj, which are equivalent to one month, three months, and six months, respectively, of outdoor exposure in a hot climate. A membrane with the construction depicted in FIG. 3 was used for all tests. Layer 11 is an 80 g/m$^2$ woven polypropylene mesh. Layers 12 comprise 20 to 35 g/m$^2$ extrusion coated polyolefins. For some samples top layer 12 is pigmented grey. For other samples top layer 12 is pigmented white. Layer 14 comprises 5 to 10 g/m$^2$ of an ethylene-ethylacrylate copolymer. Layer 13 is the non-skid coating and various formulations were evaluated. The approximate coating weight is 10 g/m$^2$. All coatings comprise the polymer composition (organic solids) and an inorganic filler, calcium carbonate. Three organic solids formulations were evaluated. The samples are 3"×6", which are not large enough for a walk-on test, but may be used to judge changes in tack as a function of exposure time and formulation variables, including organic solids compositions, membrane color, and inorganic filler/organic solids ratios. Changes in tack for the aged sample vs. the unaged counterpart are judged by touching with a fingertip.

| | Aged Skid | | | Outdoor | | Filler/ | Absorber | Antioxidant | Pigment |
|---|---|---|---|---|---|---|---|---|---|
| No. | dry | wet | Color | Exposure (months) | Organics | Organics | type/phr | type/phr* | type/phf** |
| 12 | −1.50 | −1.25 | grey | 2 | Acrynax 10127 | 3/1 | 0 | 0 | 0 |
| 13 | −1.25 | −1.25 | grey | 2 | Acrynax 10127 | 3/1 | Tin 234/0.25 | Tin770/0.25 | 0 |
| 14 | −1.75 | −2.00 | grey | 2 | Acrynax 10127 | 3/1 | Tin 234/1.25 | Tin770/1.25 | 0 |
| 58 | −1.33 | −1.75 | white | 1 | Acrynax 10127 | 3/1 | 0 | 0 | 0 |
| 59 | −1.33 | −1.75 | white | 1 | Acrynax 10127 | 3/1 | Tin 5050/5 | | 0 |
| 60 | −1.00 | −1.75 | white | 1 | Acrynax 10127 | 3/2 | 0 | 0 | 0 |
| 81 | −2.00 | −1.00 | grey | 2 | Acrynax 10127 | 3/2 | 0 | 0 | 0 |
| 93 | −1.13 | −1.00 | grey | 1.5 | Acrynax 10127 | 3/2 | 0 | 0 | TiO2/20 |
| 94 | −0.75 | −1.25 | grey | 1.5 | Acrynax 10127 | 3/1 | 0 | 0 | TiO2/20 |
| Avg | −1.34 | −1.44 | | | | | | | |
| 3 | −0.75 | −1.50 | grey | 3.75 | 3rd | | | | |
| 6 | −1.75 | −1.25 | grey | 3.75 | 3rd | | | | |
| 54 | −0.67 | −0.75 | white | 1.5 | 3rd | 3/2 | 0 | 0 | 0 |
| 55 | −0.83 | −1.75 | white | 1.5 | 3rd | 3/2 | Tin 5050/5 | | 0 |
| 56 | 0.00 | −1.00 | white | 1.5 | 3rd | 3/1 | 0 | 0 | 0 |
| 57 | −0.33 | −0.75 | white | 1.5 | 3rd | 3/1 | Tin 5050/5 | | 0 |
| Avg | −0.72 | −1.17 | | | | | | | |
| 63 | 1.00 | 0.75 | grey | 1.5 | butyl 065 | 3/2 | 0 | 0 | 0 |
| | 1.75 | 1.00 | grey | 1.5 | butyl 065 | 3/2 | Tin 5050/5 | | 0 |
| 92 | 1.00 | 0.25 | grey | 1.5 | butyl 065 | 3/1 | 0 | 0 | 0 |
| Avg | 1.25 | 0.67 | | | | | | | |
| 101 | 2.00 | −0.25 | grey | 1.5 | butyl 065/regalrez | 3/1 | 0 | 0 | 0 |

Although a direct comparison of results cannot be made because formulations differ in color, exposure time, and filler/organic solid ratios, nonetheless it can be seen that the formulations comprising the butyl 065 as the sole organic ingre- Chalking was also evaluated. When chalking occurs, the organic solids potion of the non-skid coating appears to have eroded away leaving mostly the inorganic filler. This was judged via visual observation.

| | Filler/ | | Chalking | | | Increase in Tack | | |
|---|---|---|---|---|---|---|---|---|
| | Organics | Color | 28mj | 84mj | 168mj | 28mj | 84mj | 168mj |
| Acrynac 10127 | 3/1 | grey | no | yes | yes | no | no | no |
| Acrynac 10127 | 3/1 | white | no | no | no | no | no | no |
| Acrynac 10127 | 3/2 | grey | no | no | yes | no | no | no |
| Acrynac 10127 | 3/2 | white | no | no | no | no | no | no |
| 3rd | 3/1 | grey | yes | yes | yes | no | no | no |
| 3rd | 3/1 | white | no | no | yes | no | no | no |
| 3rd | 3/2 | grey | no | yes | yes | no | no | no |
| 3rd | 3/2 | white | no | no | yes | no | no | no |
| butyl 065 | 3/1 | grey | no | slight | yes | slight | no | no |
| butyl 065 | 3/1 | white | no | no | no | slight | moderate | moderate |
| butyl 065 | 3/2 | grey | no | slight | yes | slight | no | no |
| butyl 065 | 3/2 | white | no | no | no | slight | moderate | significant |

Note that the butyl formulations exhibit an increase in tack after exposure for all samples. For the white samples the tack increases or levels after six months exposure. For the grey samples the tack increases after 28 mj of exposure, but chalking occurs after longer exposure. The implication of the increase in tack is that the butyl elastomer degraded by chain scission. For the older grey samples, the mechanism of degradation may have changed from predominantly chain scission to cross-linking. The lighter color for an all Butyl 065 polymer composition is preferred to maintain tack and skid resistance after ageing. Possibly chain scission predominates on the white membrane because of the lower exposure temperatures vs. grey.

What is claimed is:

1. A pedestrian trafficable skid-resistant flexible article, said article adapted to be stored in a roll and unrolled prior to application to a surface, said article comprising a flexible substrate suitable for application to a roof, floor or package, said flexible substrate having a first major surface adapted to contact said roof, floor or package and an opposite second major surface adapted to be exposed to pedestrian traffic, wherein said second major surface has an elastomeric non-skid coating, said elastomeric non-skid coating comprising an elastomeric polymer composition that includes about 0.1 mole % to about 10 mole % of isoprene polymer units, whereby said isoprene polymer units are capable of degrading via chain scission over time upon exposure to light and/or temperatures of about 38° to about 104° C.

2. The article of claim 1 wherein said elastomeric polymer composition comprises a copolymer of isobutylene and isoprene.

3. The article of claim 1 wherein the elastomeric non-skid coating includes inorganic filler particles that are substantially coated with the non-skid coating.

4. The article of claim 3 wherein the filler particles have an average particle size of less than about 25 μm.

5. The article of claim 1 wherein the elastomeric polymer composition comprises a polymer, a copolymer or a mixture of polymers or copolymers.

6. The article of claim 1 wherein said elastomeric polymer composition comprises about 0.5 mole % to about 5 mole % of isoprene polymer units.

7. The article of claim 6 wherein the elastomeric non-skid coating includes inorganic filler particles that are substantially coated with the elastomeric polymer composition.

8. The article of claim 7 wherein at least 98% of the filler particles within a selected 100 $cm^2$ area of the coating are completely coated by the elastomeric polymer composition.

9. The article of claim 8 wherein the filler particles comprise at least about 25 percent by volume of the non-skid coating.

10. The article of claim 1 wherein said elastomeric polymer composition comprises a copolymer of isobutylene and isoprene.

11. The article of claim 1 wherein said elastomeric polymer composition comprises butyl rubber.

12. The article of claim 1 wherein the elastomeric polymer composition has the characteristics of a pressure sensitive adhesive.

13. The article of claim 1 wherein the elastomeric non-skid coating is substantially reflective.

14. The article of claim 1 wherein the flexible substrate comprises at least one support layer comprising a woven fabric, a non-woven fabric, a polyolefin film, spun bonded polypropylene or woven polypropylene.

15. The article of claim 1 wherein the elastomeric non-skid coating has a thickness of 5 μm or less.

16. The article of claim 1 wherein the elastomeric polymer composition comprises a rubber selected from the group consisting of styrene-isoprene-styrene block copolymers, styrene-butadiene-styrene block copolymers, styrene-ethylene-butylene-styrene block copolymers, styrene/butadiene rubber, natural rubber, silicone rubber, butyl rubber, polyisoprene, polyisobutylene, chloroprene, ethylene-propylene rubber, ethylene alpha olefin, polybutadiene, nitrile rubber, and acrylic rubber.

17. The article of claim 1 wherein the volume of non-skid coating is less than about 2 $cm^3/ft^2$ (21.5 $cm^3/m^2$).

18. The article of claim 1 wherein the non-skid coating includes a tackifier and/or plasticizer.

19. The article of claim 18 wherein the non-skid coating includes a tackifier, wherein the weight ratio of elastomeric polymer composition to tackifier is about 3:1 to 2:1.

20. The article of claim 18 wherein the non-skid coating comprises Butyl 065 and Regalrez 1085 in a 2:1 weight ratio.

21. A method of improving the skid-resistance of an article comprising a flexible substrate with an elastomeric non-skid coating thereon, the method comprising:

providing the article with an elastomeric non-skid coating, said elastomeric non-skid coating comprising an elastomeric polymer composition that comprises about 0.1 mole % to about 10 mole % of isoprene polymer units, whereby said isoprene polymer units are capable of degrading via chain scission over time upon exposure to light and/or temperatures of about 38° to about 104° C.;

installing said article onto a structure such that the elastomeric non-skid coating is outwardly exposed; and exposing the article to light and/or heat for a time sufficient to increase the tack of said elastomeric non-skid coating.

* * * * *